US007800292B2

(12) United States Patent
Chang et al.

(10) Patent No.: US 7,800,292 B2
(45) Date of Patent: Sep. 21, 2010

(54) VACUUM ENVELOPE AND ELECTRON EMISSION DISPLAY USING THE VACUUM ENVELOPE

(75) Inventors: Dong-Su Chang, Youngin-si (KR); Jae-Hoon Lee, Yongin-si (KR); Hyeong-Rae Seon, Yongin-si (KR); Jae-Young Lee, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 194 days.

(21) Appl. No.: 11/734,769

(22) Filed: Apr. 12, 2007

(65) Prior Publication Data

US 2007/0247055 A1 Oct. 25, 2007

(30) Foreign Application Priority Data

Apr. 20, 2006 (KR) ..... 10-2006-0035821

(51) Int. Cl.
*H01J 1/62* (2006.01)
*H01J 1/88* (2006.01)

(52) U.S. Cl. ..... 313/495; 313/292

(58) Field of Classification Search ..... 313/310, 313/495–497, 292
See application file for complete search history.

(56) References Cited

U.S. PATENT DOCUMENTS 6,097,097 A 8/2000 Hirose
6,741,017 B1 * 5/2004 Ide et al. ..... 313/310
2003/0090197 A1 5/2003 Vaartstra
2005/0009434 A1 * 1/2005 Kanda et al. ..... 445/24
2005/0218788 A1 10/2005 Jang et al.

FOREIGN PATENT DOCUMENTS

| | | |
|---|---|---|
| JP | 09-283059 | 10/1997 |
| JP | 10-199451 | 7/1998 |
| JP | 2000-251709 | 9/2000 |
| JP | 2003-323853 | 11/2003 |
| JP | 2005-063860 | 3/2005 |
| JP | 2006-331985 | 12/2006 |
| KR | 10-2006-0001504 | 1/2006 |

OTHER PUBLICATIONS

Korean Patent Abstracts, Publication No. 1020060001504 A; Date of Publication: Jan. 6, 2006; in the name of Hyoung Cheol Seo.
European Search Report dated Sep. 20, 2007 for corresponding European Patent Application No. 07106560.1.
Japanese Office action dated Nov. 10, 2009, for corresponding Japanese application 2007-110691, noting listed references in this IDS.

* cited by examiner

*Primary Examiner*—Joseph L Williams
(74) *Attorney, Agent, or Firm*—Christie, Parker & Hale, LLP

(57) ABSTRACT

A vacuum envelope and an electron emission display having the vacuum envelope are provided. The vacuum envelope includes a first substrate and a second substrate facing the first substrate. A side member is disposed at peripheries of the first substrate and the second substrate. A first spacer is disposed between the first substrate and the second substrate at an active area of the vacuum envelope, and a second spacer is disposed between the first substrate and the second substrate at a non-active area of the vacuum envelope, the non-active area surrounding the active area. A height of the first spacer is greater than a height of the second spacer.

20 Claims, 7 Drawing Sheets

VACUUM ENVELOPE AND ELECTRON EMISSION DISPLAY USING THE VACUUM ENVELOPE

CROSS-REFERENCE TO RELATED APPLICATION

This application claims priority to and the benefit of Korean Patent Application No. 10-2006-0035821, filed on Apr. 20, 2006, in the Korean Intellectual Property Office, the entire content of which is incorporated herein by reference.

BACKGROUND OF THE INVENTION

1. Field of the Invention

The present invention relates to a vacuum envelope and an electron emission display using the vacuum envelope, and more particularly, to spacers disposed in the vacuum envelope to provide a supporting force to the vacuum envelope against an external force.

2. Description of Related Art

A conventional electron emission display includes an array of electron emission elements disposed on a first substrate and a light emission unit disposed on a second substrate. The light emission unit includes phosphor layers and an anode electrode.

The first and the second substrates are sealed together at their peripheries using a side member, and an inner space between the substrates is exhausted to form a vacuum envelope such that an emission and a migration of electrons can occur smoothly therein.

A plurality of spacers are mounted in the vacuum envelope to counter a compression force generated by a pressure difference between an interior and an exterior of the vacuum envelope.

The spacers can be classified into first spacers arranged in an active area of the vacuum envelope and second spacers arranged in a non-active area of the vacuum envelope. The active area is for displaying an image, and the non-active area is not for displaying an image. In general, the first spacers are positioned to correspond to a black layer disposed between the phosphor layers, and the second spacers are arranged along an outer circumference of the active area between the first and second substrates.

According to a conventional process for manufacturing the electron emission display, the first spacers are disposed on the active area of the vacuum envelope at the first substrate, and the second spacers are disposed on the outer circumference of the active area. Then, a side member is disposed on an edge of the first substrate. The second substrate (on which the phosphor layers, the black layer and the anode electrode are disposed) is then attached on the first substrate. Next, the inner space defined between the first and second substrates is exhausted. The manufacture of the electron emission display is thereby completed.

The compression force applied to the first and second substrates of the vacuum envelope increases gradually from outer portions of the substrates to central portions of the substrates. Therefore, the first and second substrates may be caused to have a concave shape at their central portions. That is, the central portions of the substrates may be caused to round inwardly towards the interior of the vacuum envelope such that each of the substrates has a shape of a concave lens.

As a result, a distance between the first and second substrates at an outermost portion of the active area may be greater than a distance between the first and second substrates at other portions of the vacuum envelope. Therefore, the first spacers disposed near the outermost portion of the active area may be in an unstable contact with the black layer. The unstable contact of the first spacers with the black layer distorts electron beams emitted in a vicinity of the unstable contact. A quality of light emission is thereby deteriorated.

SUMMARY OF THE INVENTION

An aspect of the present invention provides a vacuum envelope having spacers of heights configured to reduce or minimize deformations of first and second substrates, the deformations being caused by a compression force applied to the vacuum envelope and the spacers being capable of being stably disposed in the vacuum envelope. Another aspect of the present invention provides an electron emission display having the vacuum envelope.

In an exemplary embodiment of the present invention, a vacuum envelope includes a first substrate and a second substrate facing the first substrate. A side member is disposed at peripheries of the first substrate and the second substrate. A first spacer is disposed between the first substrate and the second substrate at an active area of the vacuum envelope, and a second spacer is disposed between the first substrate and the second substrate at a non-active area of the vacuum envelope, the non-active area surrounding the active area. A height of the first spacer is greater than a height of the second spacer.

A height of the side member may be less than the height of the first spacer. The height of the side member may be less than the height of the second spacer. A difference between the height of the first spacer and the height of the second spacer may be less than 50 μm. A difference between the height of the first spacer and the height of the side member may be less than 50 μm.

In another exemplary embodiment of the present invention, an electron emission display includes a first substrate and a second substrate facing the first substrate. A side member is disposed at peripheries of the first substrate and the second substrate. An electron emission unit is positioned on the first substrate at an active area of the vacuum envelope. A light emission unit is positioned on the second substrate at the active area. A first spacer is disposed between the first substrate and the second substrate at the active area. A second spacer is disposed between the first substrate and the second substrate at a non-active area of the vacuum envelope, the non-active area surrounding the active area. A height of the first spacer is greater than a height of the second spacer.

The first spacer and the second spacer may each have a shape of a rectangular post or a shape of a cylindrical post.

The electron emission unit may include cathode electrodes and gate electrodes crossing the cathode electrodes. The cathode electrodes and the gate electrodes are insulated from each other by an insulation layer disposed between the cathode electrodes and the gate electrodes. An electron emission region is positioned on one of the cathode electrodes at a crossing of the one of the cathode electrodes and a corresponding one of the gate electrodes.

The electron emission display may further include a focusing electrode positioned above the cathode electrodes and the gate electrodes.

The electron emission region may include a material selected from the group consisting of carbon nanotubes, graphite, graphite nanofibers, diamonds, diamond-like carbon, $C_{60}$, silicon nanowires, and combinations thereof.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
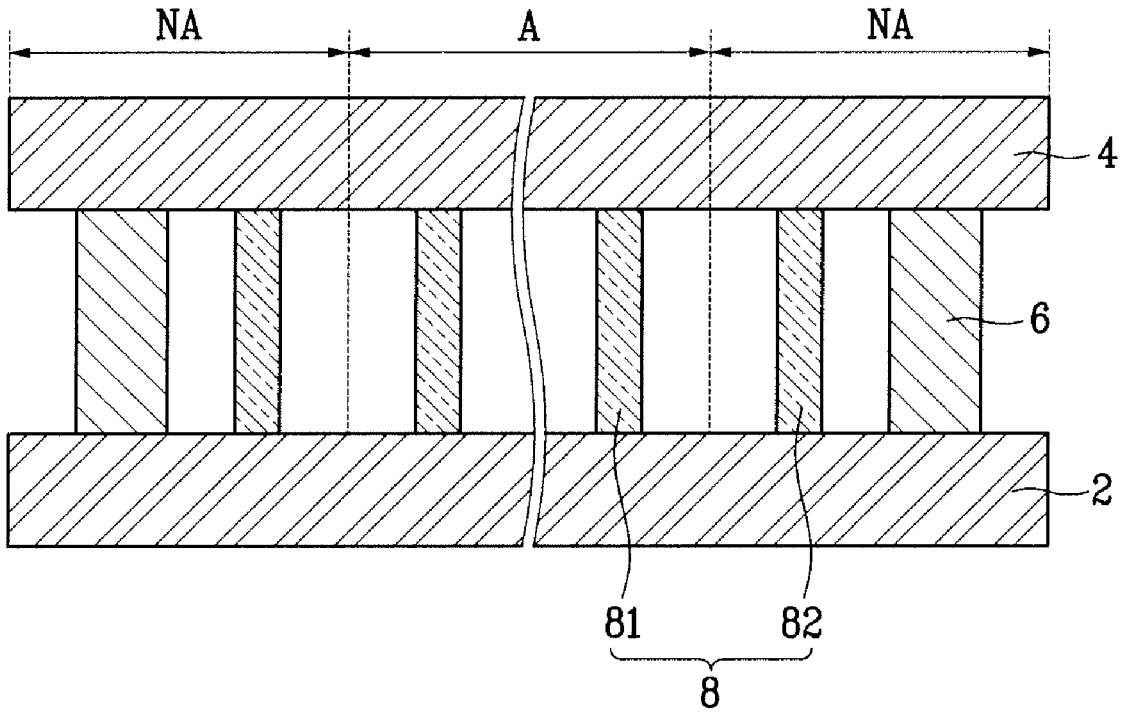
FIG. 1 is a partial sectional view of a vacuum envelope according to an embodiment of the present invention.

Referring first to FIG. 1, a vacuum envelope (or chamber) according to an embodiment of the present invention includes first and second substrates 2 and 4 facing each other and spaced apart from each other by a certain (or predetermined) distance. A side member 6 is disposed at peripheries of the first and the second substrates 2 and 4 to seal them together. An interior (between the first and second substrates 2 and 4) of the vacuum envelope is exhausted (or evacuated) such that a vacuum pressure of about $10^{-6}$ torr is maintained. That is, the first and second substrates 2 and 4 and the side member 6 form the vacuum envelope.

A plurality of spacers for countering a compression force applied to the vacuum envelope are disposed in the vacuum envelope. As shown in FIG. 1, the spacers 8 include first spacers 81 disposed at an active area A of the vacuum envelope, the active area A corresponding to active areas of the first and second substrates 2 and 4, and second spacers 82 disposed at a non-active area NA of the vacuum envelope, the non-active area NA being located at an outer circumference (or periphery) of the active area A.

In one embodiment, the second spacers 82 are provided only when a distance from each of the first spacers 81 to the side member 6 is greater than 25 mm.

When the vacuum envelope is applied to an electron emission display, the active area A and the non-active area NA may be a display area and a non-display area, respectively, of the electron emission display.

Figure 2:
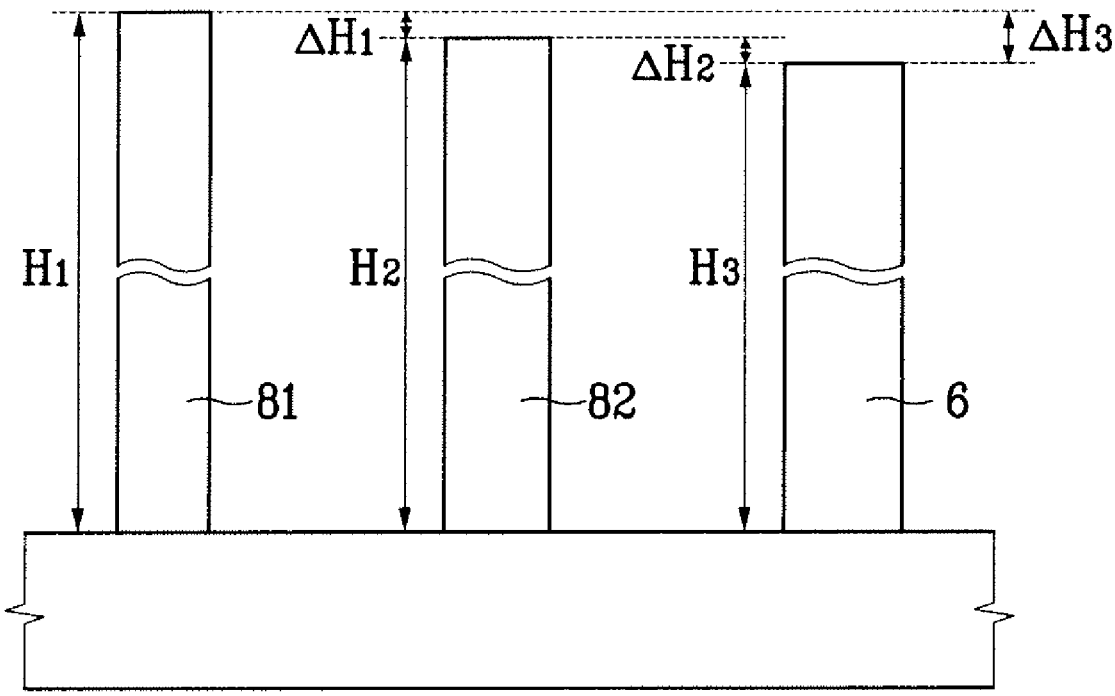
FIG. 2 is an enlarged sectional view illustrating heights of first and second spacers and a side member that are depicted in FIG. 1.

Referring to FIG. 2, a height $H_1$ of each of the first spacers 81 and a height $H_2$ of each of the second spacers 82 are configured to satisfy the following condition (1).

$$H_1 > H_2 \quad (1)$$

That is, the height $H_1$ of the first spacers 81 is greater than the height $H_2$ of the second spacers 82.

In addition, a height $H_3$ of the side member 6 is configured to satisfy the following condition (2).

$$H_1 > H_3 \quad (2)$$

That is, the height $H_1$ of the first spacers 81 is greater than the height $H_3$ of the side member 6.

Furthermore, the height $H_2$ and the height $H_3$ are configured to satisfy the following condition (3).

$$H_2 > H_3 \quad (3)$$

That is, the height $H_2$ of the second spacers 82 is greater than the height $H_3$ of the side member 6.

In view of the above conditions (1), (2) and (3), a first spacer of the first spacers 81 that is closest to a central portion of the vacuum envelope is tallest in height, and the side member 6 which is farthest from the central portion of the vacuum envelope is shortest in height.

Reasons for setting the heights of the first and second spacers 81 and 82 and the side member 6 as described above will now be explained.

The compression force applied to the first and second substrates 2 and 4 of the vacuum envelope increases gradually from outer portions of the substrates to central portions of the substrates. Therefore, the substrates may be caused to have a concave shape at their central portions. That is, the central portions of the substrates may be caused to round inwardly towards the interior of the vacuum envelope such that each of the substrates has a shape of a concave lens. Therefore, a distance between the first and second substrates 2 and 4 increases gradually in length from the central portions of the substrates to the outer portions of the substrates. Therefore, the second spacers 82 disposed at the outer portions of the substrates may be caused to be in an unstable contact with the first and/or second substrates 2 and 4 due to an increased distance between the first and second substrates 2 and 4. This may cause a contact error of the second spacers 82 to result. Therefore, the first spacers 81 disposed near (or at) the central portion of the vacuum envelope are configured to be taller in height to more effectively counter the increased compression force at the central portion of the vacuum envelope. Therefore, the distance between the first and second substrates 2 and 4 can be more uniformly maintained. Therefore, the first and second spacers 81 and 82 and the side member 6 are configured so as to satisfy the above conditions (1), (2) and (3).

Height differences $\Delta H_1$, $\Delta H_2$, and $\Delta H_3$ respectively corresponding to a height difference between the first and second spacers 81 and 82, a height difference between the second spacers 82 and the side member 6, and a height difference between the first spacers 81 and the side member 6 (see, for example, FIG. 2) are each less than 50 μm.

When any of the height differences $\Delta H_1$, $\Delta H_2$, and $\Delta H_3$ is greater than 50 μm, the first and second substrates 2 and 4 may be cracked during the sealing process for sealing the first and second substrates 2 and 4.

The first spacers 81 and the second spacers 82 may have any of a variety of suitable shapes such as a shape of a rectangular post (having a rectangular cross section) or a shape of a cylindrical post (having a circular cross section).

The above-described vacuum envelope may be applied to an electron emission display.

Figure 3:
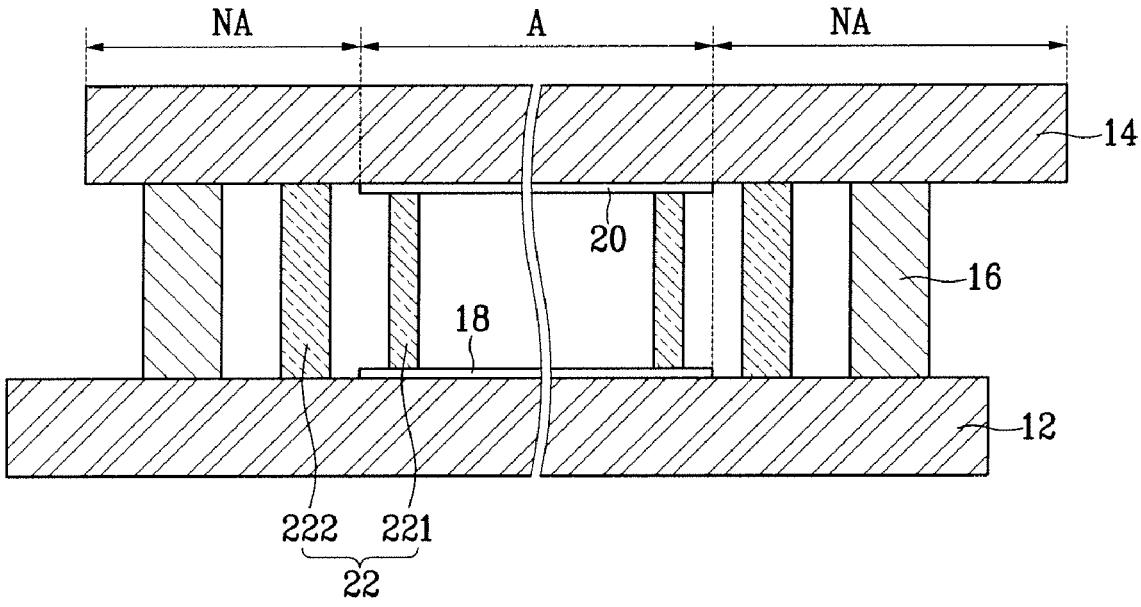
FIG. 3 is a partial sectional view of an electron emission display according to an embodiment of the present invention.
Figure 4:
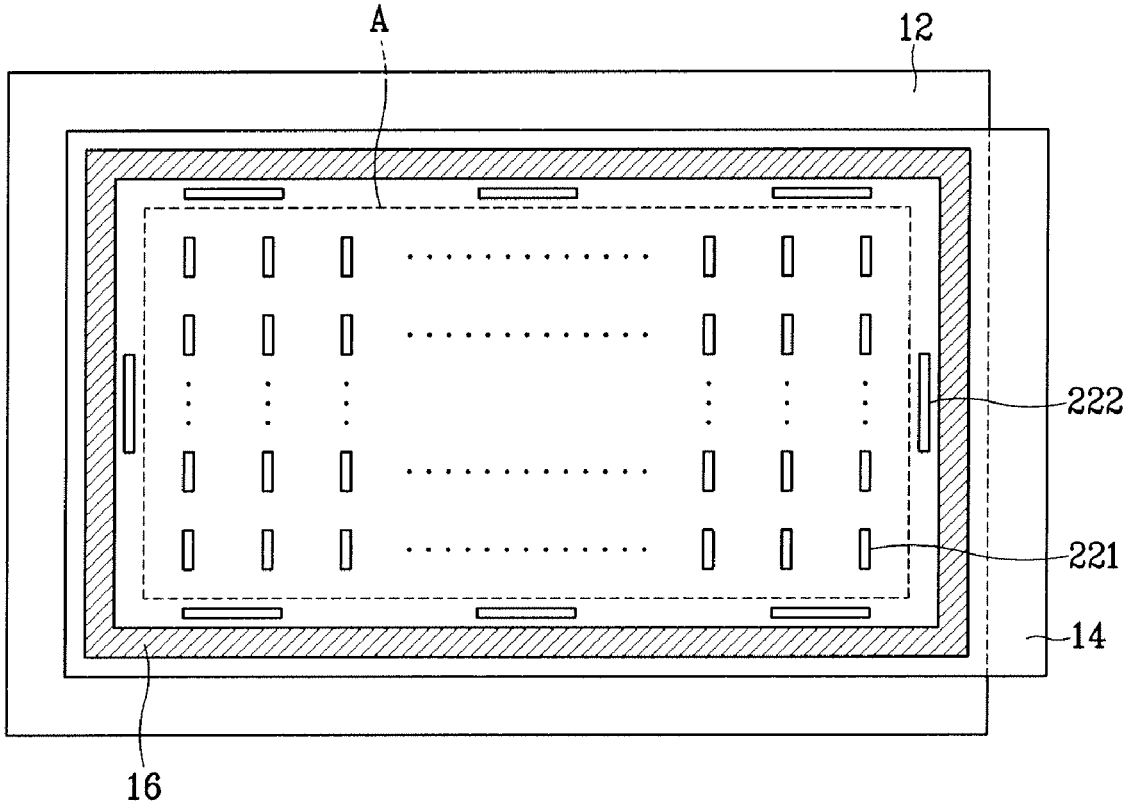
FIG. 4 is a top view of the electron emission display of FIG. 3.
Figure 5:
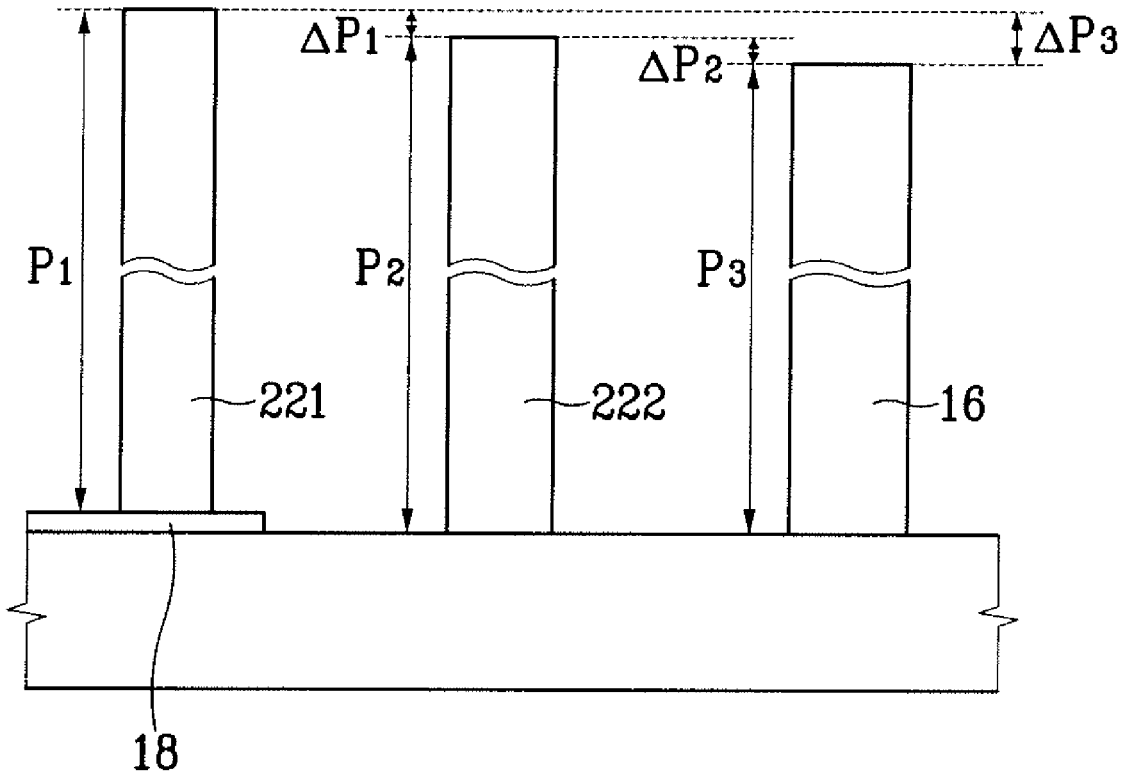
FIG. 5 is an enlarged sectional view illustrating heights of first and second spacers and a side member that are depicted in FIG. 3.

FIGS. 3 through 5 show an electron emission display according to an embodiment of the present invention.

Referring first to FIGS. 3 and 4, the electron emission display includes a vacuum envelope having first and second substrates 12 and 14 facing each other and spaced apart by a certain (or predetermined) distance. A side member 16 disposed at peripheries of the first and the second substrates 12 and 14 to seal them together.

An electron emission unit 18 on which electron emission elements are arrayed is located on a surface of the first substrate 12 facing the second substrate 14, thereby forming an electron emission device. The first substrate 12 on which the electron emission unit 18 is located is combined with the second substrate 14 on which a light emission unit 20 is located to form the electron emission display.

The electron emission unit 18 is disposed on the first substrate 12 at an active area A which is for displaying an image, and the light emission unit 20 is disposed on the second substrate 14 at the active area A.

A plurality of spacers 22 for countering a compression force applied to the vacuum envelope are disposed in the vacuum envelope. The spacers 22 include first spacers 221 disposed between the electron emission unit 18 and the light emission unit 20 at the active area A and second spacers 222 disposed at a non-active area NA surrounding the active area A.

Referring to FIG. 5, a height P1 of the first spacers 221 is greater than a height P2 of the second spacers 222 (i.e., P1>P2).

The height P1 of the first spacers 221 may include a thickness of the electron emission unit 18. Even when the height P1 of the first spacers 221 includes the thickness of the electron emission unit 18, since the thickness of the electron emission unit 18 is typically less than 5 μm, which is within an error range in embodiments of the present invention, a height variation of the first spacers 221 due to the thickness of the electron emission unit 18 can be negligible.

In addition, the height P1 of the first spacers 221 is greater than a height P3 of the side member 16 (i.e., P1>P3).

Furthermore, the height P2 of the second spacers 222 is greater than the height P3 of the side member 16 (i.e., P2>P3).

Height differences ΔP1, ΔP2, and ΔP3 respectively corresponding to a height difference between the first and second spacers 221 and 222, a height difference between the second spacers 222 and the side member 16, and a height difference between the first spacers 221 and the side member 16 are each less than 50 μm.

Since reasons for setting the heights of the spacers 221 and 222 and the side member 16 are substantially similar to those explained above in reference to FIG. 2, a detailed explanation thereof will be omitted below.

The first and second spacers 221 and 222 may have any of a variety of suitable shapes such as a shape of a rectangular post (having a rectangular cross section) or a shape of a cylindrical post (having a circular cross section).

By way of example, when the first and second spacers 221 and 222 have the shape of the rectangular post, a ratio of a height to a width of the first spacers 221 may be 1:0.042, and a ratio of a height to a width of the second spacers 222 may be 1:1.

Figure 6:
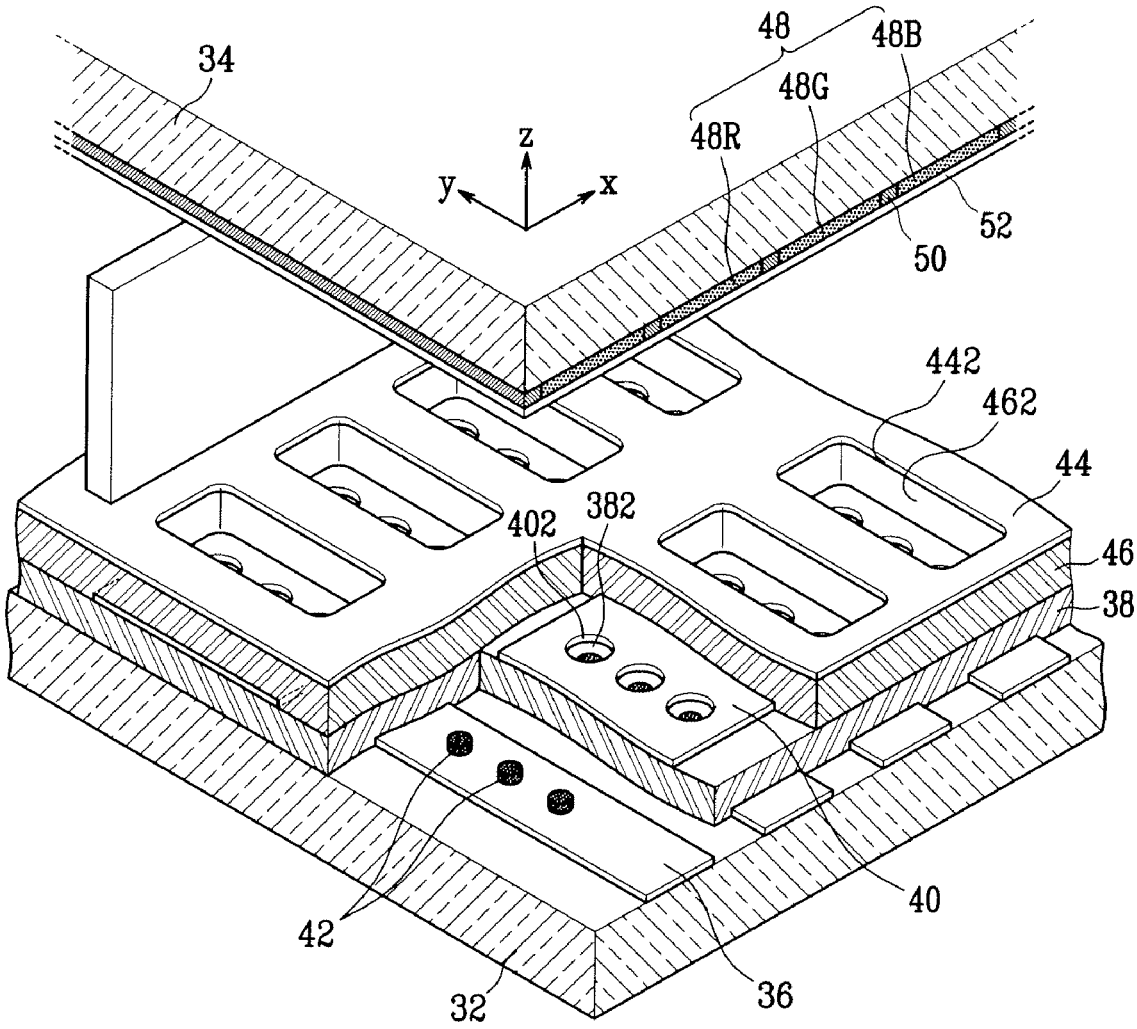
FIG. 6 is an exploded perspective view of an electron emission display having an array of Field Emitter Array (FEA) elements, according to an embodiment of the present invention.

FIG. 6 shows an electron emission display having an array of Field Emitter Array (FEA) elements, an electron emission unit and a light emission unit. The electron emission display can be applied in an embodiment of the present invention.

Referring to FIG. 6, a plurality of cathode electrodes 36 are positioned on a first substrate 32 in a striped pattern to extend along a first direction (a direction of a y-axis in FIG. 6). A first insulation layer 38 is positioned on the first substrate 32 to cover the cathode electrodes 36. A plurality of gate electrodes 40 are positioned on the first insulation layer 38 in a striped pattern to extend along a second direction (a direction of an x-axis in FIG. 6) to cross the cathode electrodes 36 at right angles.

Regions at where the cathode electrodes 36 are crossed by the gate electrodes 40 defines unit pixels. Electron emission regions 42 are positioned on the cathode electrodes 36 to correspond to the unit pixels. In addition, first and second openings 382 and 402 corresponding to the electron emission regions 42 are respectively positioned on the first insulation layer 38 and the gate electrodes 40 to expose the electron emission regions 42.

The electron emission regions 42 may be formed of a material which emits electrons when an electric field is applied thereto in a vacuum atmosphere. By way of example, the material may be a carbonaceous material and/or a nanometer-sized material. For example, the electron emission regions 42 may be formed of carbon nanotubes, graphite, graphite nanofibers, diamonds, diamond-like carbon, $C_{60}$, silicon nanowires, and/or combinations thereof.

Alternatively, the electron emission regions 42 may be formed of a molybdenum-based material and/or a silicon-based material. In this alternative situation, the electron emission regions 42 may have a shape with a pointed tip.

Two or more of the electron emission regions 42 may be positioned at each of the unit pixels (see, for example, FIG. 6). Here, the two or more of the electron emission regions 42 may be positioned in a line extending along a length of one of the cathode and gate electrodes 36 and 40. The electron emission regions 42 may have a circular top surface. However, embodiments of the present invention are not limited to the position and the shape of the electron emission regions 42, as described above.

Although a case where the gate electrodes 40 are disposed above the cathode electrodes 36 with the first insulation layer 38 interposed therebetween is described, embodiments of the present invention are not limited to this case. By way of example, the cathode electrodes 36 may be disposed above the gate electrodes 40 with the first insulation layer 38 interposed therebetween. Here, the electron emission regions 42 may be positioned on the first insulation layer 38 such that the electron emission regions 42 contact one side surface of the cathode electrodes 36.

A second insulation layer 46 and a focusing electrode 44 are successively positioned on the gate electrodes 40 and the first insulation layer 38. The second insulation layer 46 is positioned under the focusing electrode 44 to insulate the gate electrodes 40 from the focusing electrode 44. Openings 462 and 442 for allowing electron beams to pass through the second insulation layer 46 and the focusing electrode 44 are respectively positioned on the second insulation layer 46 and the focusing electrode 44.

Here, each of the openings 442 of the focusing electrode 44 corresponds to one of the unit pixels for focusing electrons emitted from the one of the unit pixels. Alternatively, each of the openings 442 of the focusing electrode 44 corresponds to a respective one of the openings 402 of the gate electrodes 40 for focusing electrons emitted from one of the electron emission regions 42. The former is shown in FIG. 6.

On a surface of the second substrate 34 facing the first substrate 32, phosphor layers 48 (e.g., red, green and blue phosphor layers 48R, 48G and 48B) are positioned and spaced apart from each other at certain (or predetermined) intervals. A black layer 50 is formed between the phosphor layers 48 to improve a contrast of a screen (or an image).

An anode electrode 52 formed of a conductive material such as aluminum is positioned on the phosphor and black layers 48 and 50. The anode electrode 52 heightens a screen brightness by receiving a high voltage for accelerating electron beams and reflecting visible light rays radiated from the phosphor layers 48 to the first substrate 32 back toward the second substrate 34.

Alternatively, the anode electrode 52 can be formed of a transparent conductive material, such as Indium Tin Oxide (ITO), rather than a metallic material. Here, the anode electrode 52 is placed on the second substrate 34, and the phosphor and black layers 48 and 50 are positioned on the anode electrode 52.

Figure 7:
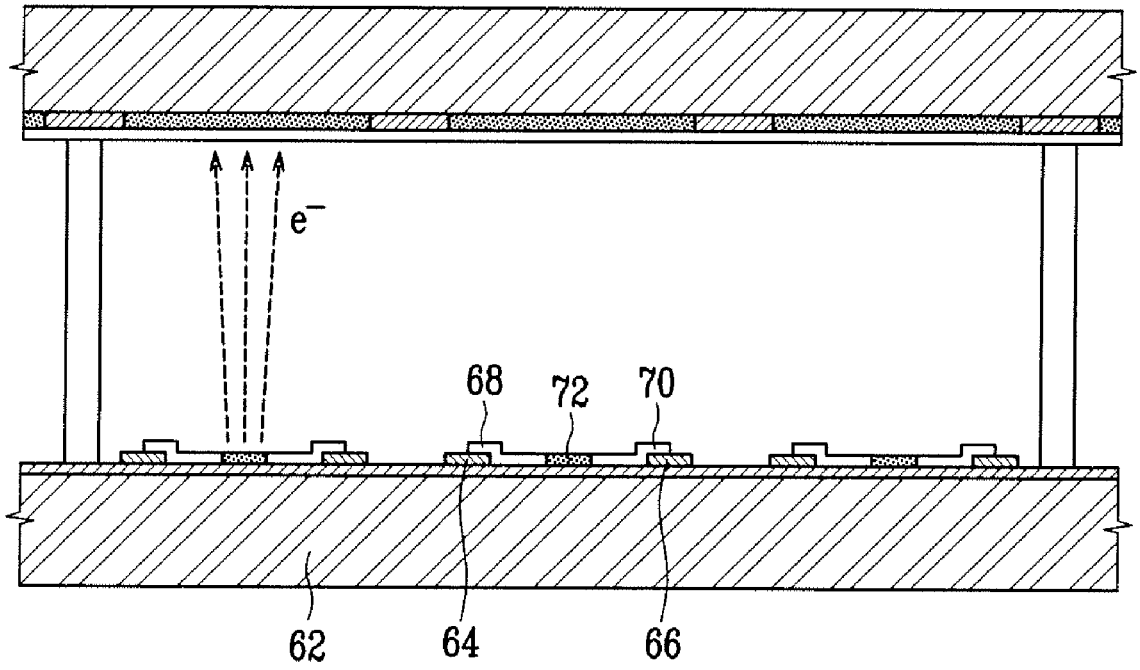
FIG. 7 is an exploded perspective view of an electron emission display having an array of Surface Conduction Emitter (SCE) elements, according to an embodiment of the present invention.

FIG. 7 shows an electron emission display having an array of Surface Conduction Emitter (SCE) elements, an electron emission unit and a light emission unit. The electron emission display can be applied in embodiments of the present invention.

Referring to FIG. 7, the electron emission display is substantially identical to the electron emission display depicted in FIG. 6, except for an electron emission unit positioned on a first substrate.

That is, first and second electrodes 64 and 66 are positioned on the first substrate 62, and first and second conductive layers 68 and 70 are positioned to partly cover portions of the first and second electrodes, respectively. Electron emission regions 72 are positioned between the first and second conductive layers 68 and 70 and are electrically connected to the first and second conductive layers 68 and 70. The electron emission regions 72 are electrically connected to the first and second electrodes 64 and 66 through the first and second conductive layers 68 and 70, respectively.

The first and second electrodes 64 and 66 may be formed of any of a variety of suitable conductive materials, and the first and second conductive layers 68 and 70 may be formed of a conductive material such as Ni, Au, Pt, or Pd.

The electron emission regions 72 may be formed of carbon nanotubes, graphite, graphite nanofibers, diamonds, diamond-like carbon, $C_{60}$, silicon nanowires, or combinations thereof.

In described embodiments, a vacuum envelope of embodiments of the present invention is applied to an electron emission display having an array of FEA elements or SCE elements. However, embodiments of the present invention are not limited to these examples. That is, a vacuum envelope of embodiments of the present invention can also be applied to an electron emission display having an array of Metal-Insulator-Metal (MIM) elements and/or Metal-Insulator-Semiconductor (MIS) elements.

According to embodiments of the present invention, the heights of the spacers are optimized or set to reduce or minimize a deformation of the substrates caused by the compression force. In addition, since the spacers can be securely disposed on the substrates, the contact error of the spacers can be prevented, thereby preventing an abnormal light emission. As a result, an image of high quality can be displayed.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A vacuum envelope, comprising:

a first substrate;

a second substrate facing the first substrate;

a side member located between the first substrate and the second substrate at peripheries of the first substrate and the second substrate to seal the vacuum envelope and maintain a substantially uniform distance between the first substrate and the second substrate along the peripheries;

a first spacer disposed between the first substrate and the second substrate at an active area of the vacuum envelope; and a second spacer disposed between the first substrate and the second substrate at a non-active area of the vacuum envelope, the non-active area surrounding the active area, wherein a height of the first spacer is greater than a height of the second spacer, and wherein a height of the side member is less than the height of the second spacer, wherein a difference between the height of the first spacer and the height of the second spacer is less than 50 μm.

2. The vacuum envelope of claim 1, wherein a difference between the height of the first spacer and the height of the side member is less than 50 μm.

3. The vacuum envelope of claim 1, wherein the height of the second spacer is greater than the height of the side member by a value less than 50 μm.

4. The vacuum envelope of claim 1, wherein the first spacer has a shape of a rectangular post or a shape of a cylindrical post.

5. The vacuum envelope of claim 1, wherein the second spacer has a shape of a rectangular post or a shape of a cylindrical post.

6. The vacuum envelope of claim 1, wherein a shortest distance between the first and second substrates from any point on the first substrate varies by less than 50 μm from a shortest distance between the first and second substrates from any other point on the first substrate.

7. The vacuum envelope of claim 1, wherein the active area is configured to display an image and the non-active area is not configured to display an image.

8. An electron emission display, comprising:

a first substrate;

a second substrate facing the first substrate;

a side member located between the first substrate and the second substrate at peripheries of the first substrate and the second substrate to form a vacuum envelope and maintain a substantially uniform distance between the first substrate and the second substrate along the peripheries;

an electron emission unit disposed on the first substrate at an active area of the vacuum envelope;

a light emission unit disposed on the second substrate at the active area;

a first spacer disposed between the first substrate and the second substrate at the active area; and a second spacer disposed between the first substrate and the second substrate at a non-active area of the vacuum envelope, the non-active area surrounding the active area, wherein a height of the first spacer is greater than a height of the second spacer, and wherein a height of the side member is less than the height of the second spacer, wherein a difference between the height of the first spacer and the height of the second spacer is less than 50 μm.

9. The electron emission display of claim 8, wherein a difference between the height of the first spacer and the height of the side member is less than 50 μm.

10. The electron emission display of claim 9, wherein the first spacer and the second spacer each have a shape of a rectangular post or a shape of a cylindrical post.

11. The electron emission display of claim 8, wherein the electron emission unit comprises:

a plurality of cathode electrodes;

a plurality of gate electrodes crossing the cathode electrodes, the cathode electrodes and the gate electrodes being insulated from each other by an insulation layer disposed between the cathode electrodes and the gate electrodes; and an electron emission region disposed on one of the cathode electrodes at a crossing of the one of the cathode electrodes and a corresponding one of the gate electrodes.

12. The electron emission display of claim 11, further comprising a focusing electrode disposed above the cathode electrodes and the gate electrodes.

13. The electron emission display of claim 12, wherein the electron emission region comprises a material selected from the group consisting of carbon nanotubes, graphite, graphite nanofibers, diamonds, diamond-like carbon, $C_{60}$, silicon nanowires, and combinations thereof.

14. The electron emission display of claim 8, wherein a shortest distance between the first and second substrates from any point on the first substrate varies by less than 50 μm from a shortest distance between the first and second substrates from any other point on the first substrate.

15. The electron emission display of claim 8, wherein the active area is configured to display an image and the non-active area is not configured to display an image.

16. The electron emission display of claim 8, wherein the height of the second spacer is greater than the height of the side member by a value less than 50 μm.

17. A vacuum envelope comprising:

a first substrate;

a second substrate facing the first substrate, a shortest distance between the first and second substrates from any point on the first substrate varying by less than 50 μm from a shortest distance between the first and second substrates from any other point on the first substrate;

a side member located between the first and second substrates at peripheries of the first and second substrates to seal the vacuum envelope, a height of the side member being a largest distance between the first and second substrates as measured from the peripheries of the first and second substrates;

an active area configured to display an image;

a non-active area surrounding the active area and not configured to display an image;

a first spacer between the first and second substrates at the active area; and a second spacer between the first and second substrates at the non-active area, wherein a height of the first spacer is greater than a height of the second spacer, and wherein the height of the side member is less than the height of the second spacer.

18. A vacuum envelope comprising:

a first substrate;

a second substrate facing the first substrate, a shortest distance between the first and second substrates from any point on the first substrate varying by less than 50 μm from a shortest distance between the first and second substrates from any other point on the first substrate;

a side member located between the first and second substrates at peripheries of the first and second substrates to seal the vacuum envelope, a height of the side member being a largest distance between the first and second substrates as measured from the peripheries of the first and second substrates;

first and second spacers between the first and second substrates and configured to counter a compression force applied to the vacuum envelope, the first spacer being closer to a central portion of the vacuum envelope than the second spacer;

wherein a height of the first spacer is greater than a height of the second spacer, and wherein the height of the side member is less than the height of the second spacer.

19. The vacuum envelope of claim 18, wherein a shortest distance between the second spacer and the side member is not greater than 25 mm.

20. The vacuum envelope of claim 18, wherein the vacuum envelope is configured to display an image.

* * * * *